US005515060A

United States Patent [19]

Hussain et al.

[11] Patent Number: 5,515,060

[45] Date of Patent: May 7, 1996

[54] CLUTTER SUPPRESSION FOR THINNED ARRAY WITH PHASE ONLY NULLING

[75] Inventors: Moayyed A. Hussain, Menands; Kai-Bor Yu, Schenectady; Koeunyi Bae, Ithaca, all of N.Y.

[73] Assignee: Martin Marietta Corp., Moorestown, N.J.

[21] Appl. No.: 439,541

[22] Filed: May 11, 1995

[51] Int. Cl.[6] ..... H01Q 3/00

[52] U.S. Cl. ..... 342/376; 342/372; 342/157

[58] Field of Search ..... 342/372, 376, 342/154, 157, 81

[56] References Cited

U.S. PATENT DOCUMENTS

| | | | |
|---|---|---|---|
| 5,115,243 | 5/1992 | Perry et al. | 342/158 |
| 5,233,356 | 8/1993 | Lee et al. | 342/368 |

OTHER PUBLICATIONS

"Phase Array Antenna Handbook", Mailloux, R. I., Artech House, Boston, 1993.

"Design of Circular Aperture for Narrow Beam Width and Low Sidelobes", Taylor, T. T., IRE Transactions on Antenna and Propagation, 1/60, pp. 17–22.

"Adaptive Sidelobe Nulling Using Digitally Controlled Phase Shifter" Baird, C. A. & Rassweiler, G. G., IEEE Trans. 1976 AP–24, pp. 638–649.

"Simple Method for Phase Nulling by Phase Perturbation", Steyskal, H., IEEE Trans., 1983, AP–31, pp. 163–166.

"General Radiation–Pattern Synthesis Technique for Array Antenna of Arbitrary Configuration and Element Type", IEEE Proceedings, vol. 135, Pt.H. No. 4, 1988, pp. 241–248.

*Primary Examiner*—Theodore M. Blum

*Attorney, Agent, or Firm*—William H. Meise; Carlos A. Nieves; Stephen A. Young

[57] ABSTRACT

An active array antenna for use, for example, in a radar system, includes elemental antennas, each with a T/R module, distributed over a circular aperture. For lowest cost, the aperture is thinned. The T/R modules are operated at maximum output, to achieve maximum DC-to-RF efficiency, and for simplicity. A phase controller controls the phase shift which is imparted by each module to its signal, to form a main beam and its associated sidelobes. A perturbation phase generator portion of a phase controller adds a perturbation phase shift selected, in conjunction with a particular thinning distribution, to form a relatively wide null in the sidelobe structure, in which signal transduction is reduced. In a radar context, this null may be placed on a source of ground clutter or a jammer.

1 Claim, 7 Drawing Sheets

CLUTTER SUPPRESSION FOR THINNED ARRAY WITH PHASE ONLY NULLING

FIELD OF THE INVENTION

This invention relates to array antennas useful for radar. More particularly, this invention relates to a thinned antenna array in which a substantial fraction of the total number of element slots are not populated, and the rest of the element slots are spaced in such way that the performance of the system beam patterns are maintained, and in which the active elements are phase controlled to provide clutter nulling.

BACKGROUND OF THE INVENTION

Phased array antennas or transducers are used for many purposes, including radars to detect and track targets, for sonar, for ultrasound and for sensing. A comprehensive description of phased arrays in radar and communication systems appear in a text entitled "Phased Array Antenna Handbook", authored by J. Mailloux, published by Artech House, Boston 1994, and incorporated herein by reference. Those skilled in the art know that antennas are reciprocal devices, and that characteristics of a particular antenna are same in both transmission and reception modes. Ordinarily a description of the operation of an antenna is couched in terms of either transmission or reception, with the other mode understood therefrom.

Those skilled in the art know that each array antenna produces undesired sidelobes in addition to one or more main lobes, and the sidelobes have fixed magnitudes if the antenna elements are uniformly illuminated. The magnitudes of the sidelobes can be controlled by control of the aperture illumination distribution (distribution of currents), but at the expense of loss of the directive gain or power of the antenna.

In addition to their military uses, array antennas are increasingly being used for commercial purposes, such as for airport terminal surveillance systems. An active antenna aperture is defined as one in which each receiving or transmitting element has its own amplifiers, power source, phase shifters and phase controllers, which are often combined into a transmit-receive (T/R or TR) module. The T/R modules of an array antenna may be expensive to manufacture, and the elements of the array may account for about one-third the cost of the radar. Commercial marketability is very price-dependent; any cost reduction is very desirable. Dramatic reductions in the cost and increases in the performance of a radar may be achieved by a) selectively thinning the array, thereby reducing the number of antenna elements and T/R modules, and locating the remaining elements for a given aperture in such a fashion as to reduce the sidelobe level without reducing the output power of each of the T/R modules and b) reducing ground or weather clutter by forming wide radar nulls in selected clutter regions without reducing the transmitted power (phase only control).

SUMMARY OF THE INVENTION

An active array antenna for use, for example, in a radar system, includes elemental antennas, each with a T/R module, distributed over a circular aperture. For lowest manufacturing cost, the aperture is thinned, and the thinning is accomplished in a manner which improves the sidelobe levels relative to the fully populated array. The T/R modules are operated at maximum output, to achieve maximum DC-to-RF efficiency, and for simplicity, reliability, and cost reduction. A phase controller controls the phase shift which is imparted by each module to its signal, to form and direct a main beam and its associated sidelobes from the array antenna. A perturbation phase generator adds a perturbation phase shift selected, in conjunction with a particular thinning distribution, to form a relatively wide null in the sidelobe structure in a particular direction. The direction of the null is selected to be one in which signal transduction is to be reduced. In a radar context, this null may be directed toward a source of ground clutter or an active jammer, to reduce the signal transmitted toward the clutter reflector in a transmit mode without reducing the receive gain, or to reduce the clutter signal from the clutter direction in a receive mode, or both. To reduce the computing complexity, the system is based on the minimum-norm method. Hence, the phase perturbations for the null it can be easily implemented in real time.

In addition, "control points" displaced in a particular manner are used to control the depth of the nulls. The number of the control points, and their relative locations, establish the location, width and depth of the resulting null in the radiation pattern.

The preferred embodiment uses antenna elements or T/R modules located on a triangular grid, for improved grating lobe performance when the element spacing exceeds $\lambda/2$.

DESCRIPTION OF THE INVENTION

Figure 1B:
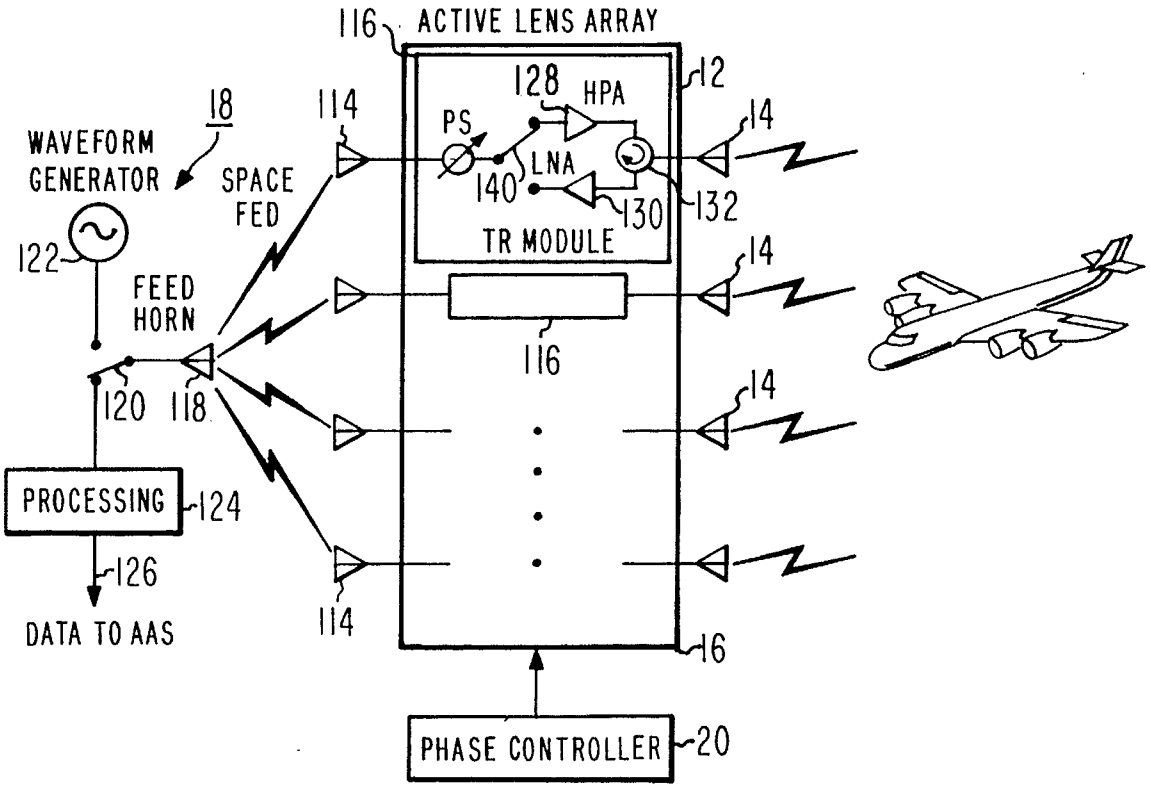
FIG. 1*b* is a simplified block diagram of a space-feed embodiment of the invention.
Figure 1A:
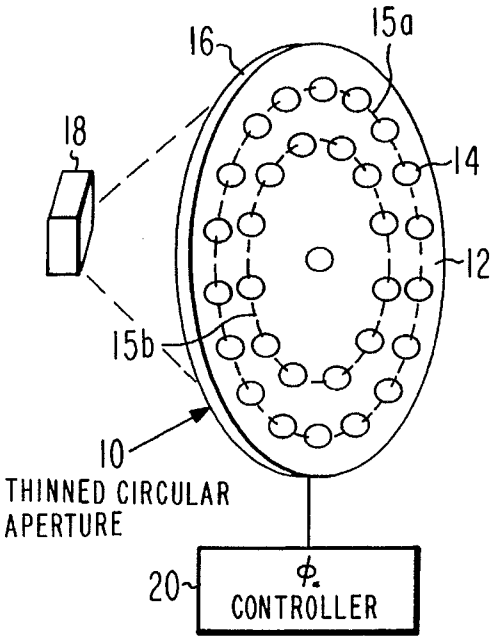
FIG. 1*a* is a simplified representation of the circular architecture of an array in accordance with the invention, including a plurality of spaced-apart elements, equally spaced on concentric rings, thinned according to an aspect of the invention.

In FIG. 1*a*, a thinned circular antenna array designated generally as 10 includes a front face 12, which accommodates a plurality of elemental antenna elements, some of which are designated 14. The front surface 12 of array antenna 10 may also accommodate a plurality of T/R modules (not illustrated in FIG. 1*a*), which are connected to antennas 14. The antenna elements 14 of aperture 10 are equally spaced on a plurality of concentric circles, or rings, some of which are designated 15*a* and 15*b*.

Those skilled in the art know that the elements of array antennas must be fed with properly phased signals in order to generate the appropriate radiation pattern. In the arrangement of FIG. 1*a*, the feed is a "space feed" including feed 18. Space feeds are well-known in the art, and are described, for example, in U.S. Pat. No. 5,115,243, issued May 19, 1992 in the name of Perry et al. The appropriate relative phase at each antenna element is achieved by a combination of relative phase shifts or delays which arise from the phase contour of the wavefront arriving at array 10 from feed 18, and in part by further phase shifts on delays imparted to the various T/R modules by a phase ($\phi$) controller designated 20. Thus, support section 16 of array antenna 10 acts as a controlled lens, to redirect the beam radiated by feed 18.

FIG. 1*b* is a simplified cross-sectional view of the arrangement of FIG. 1*a*, illustrating the space feed and some details of a T/R module. As illustrated in FIG. 1*b*, the space feed includes a plurality of elemental feed antennas 114, each of which is connected, by way of a T/R module 116, to a corresponding one of array elemental antennas 14. Antenna feed 18 includes a radiator, which is illustrated as a horn 118 in FIG. 1*b*, and also includes a transmit-receive apparatus, illustrated by a mechanical switch symbol 120, connected to a waveform generator 122 for transmit-mode operation, and to a receive signal processing block 124 for receive-mode operation. Processing block 124 performs receive signal processing as known in the art, and as described, for example, in the above-mentioned Perry et al. patent. The processed signal output from block 124 is made available on a signal path 126 to other processors and to displays.

Each Transmit-Receive (T/R) module 116 of FIG. 1*b* includes a high-power amplifier (HPA) 128, a low-noise amplifier (LNA) 130, both of which are coupled to the corresponding elemental radiating antenna 14 by a circulator 132, which couples transmit signals from the output of HPA 128 to elemental radiating antenna 14 for radiation toward a target, and for coupling signals received from a target to the input of LNA 130. A transmit-receive switching arrangement 140 within T/R module 116 provides essentially the same function to each T/R module that transmit-receive switch 120 provides to the feed, namely switching the signal paths according to the transmit or receive mode of operation of the radar system.

A phase shifter (PS) 152 within each T/R module 116 of FIG. 16 phase shifts the transmitted and received signals by an amount established by phase controller 20. The amount of phase shift is established, according to the invention, in conjunction with the phase contour of the feed 18, and in accordance with the preset thinning of the circular array, to steer or direct the main lobe of the radiated beam of electromagnetic energy in the desired direction, with a sidelobe pattern which includes a broad null at a desired location in the radiation pattern. In general, the location of the null is selected to reduce the amount of energy radiated toward, and/or received from, locations in which "clutter" sources exist. This, in turn, reduces the amplitude of the clutter signals, and imposes a lesser burden on the signal processing to remove or ameliorate the clutter display. As an alternative, the same amount of clutter-removing processing may be used, with additional suppression provided by the null.

Clutter suppression is important for radar generally, as well as for air traffic control radar. Surface clutter from the ground in the lower beams or volume clutter from atmospheric conditions in the higher beams can contribute to an increase in false detection rates.

Clutter rejection by the use of a null, generated as described, below reduces clutter by reducing the amount of power transmitted toward the clutter reflectors, without reducing the gain in the receive mode. The nulling is accomplished by phase-only control, thereby allowing all of the T/R modules to transmit at maximum power, without attenuation. This, in turn, makes for simpler control in the T/R module, and increases the DC-to-RF power conversion efficiency.

Figure 2A:
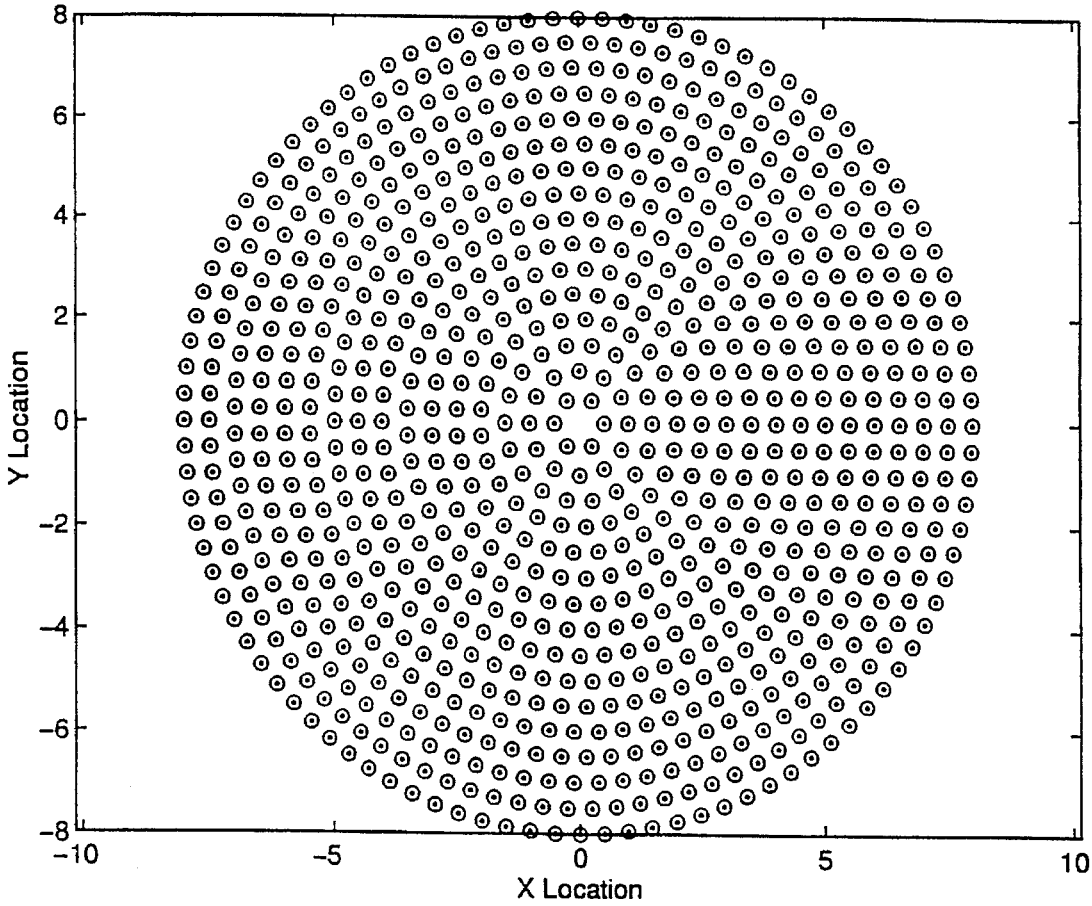
FIG. 2*a* is a simplified representation of a typical fully populated array aperture.
Figure 2B:
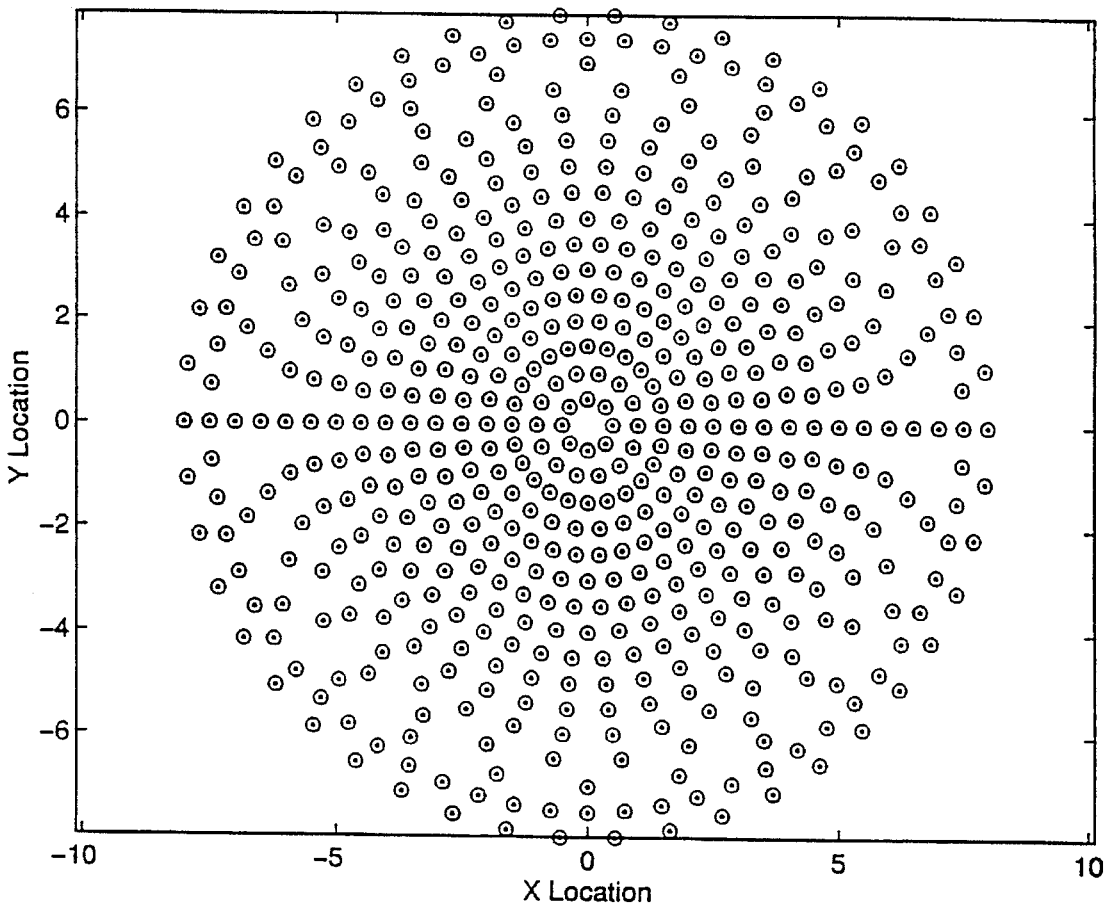
FIG. 2*b* shows the same aperture thinned or space tapered according to the invention.

FIG. 2*a* illustrates, for reference, a circular aperture fully populated with a total of 846 elements 14 in sixteen concentric rings of elements. FIG. 2*b* illustrates the same aperture, but thinned (space tapered) to a population of 556 elements in accordance with the invention. In each ring, the antenna elements remaining in the population are equally spaced from each other, which corresponds to equal angular spacing about the ring.

Figure 3A:
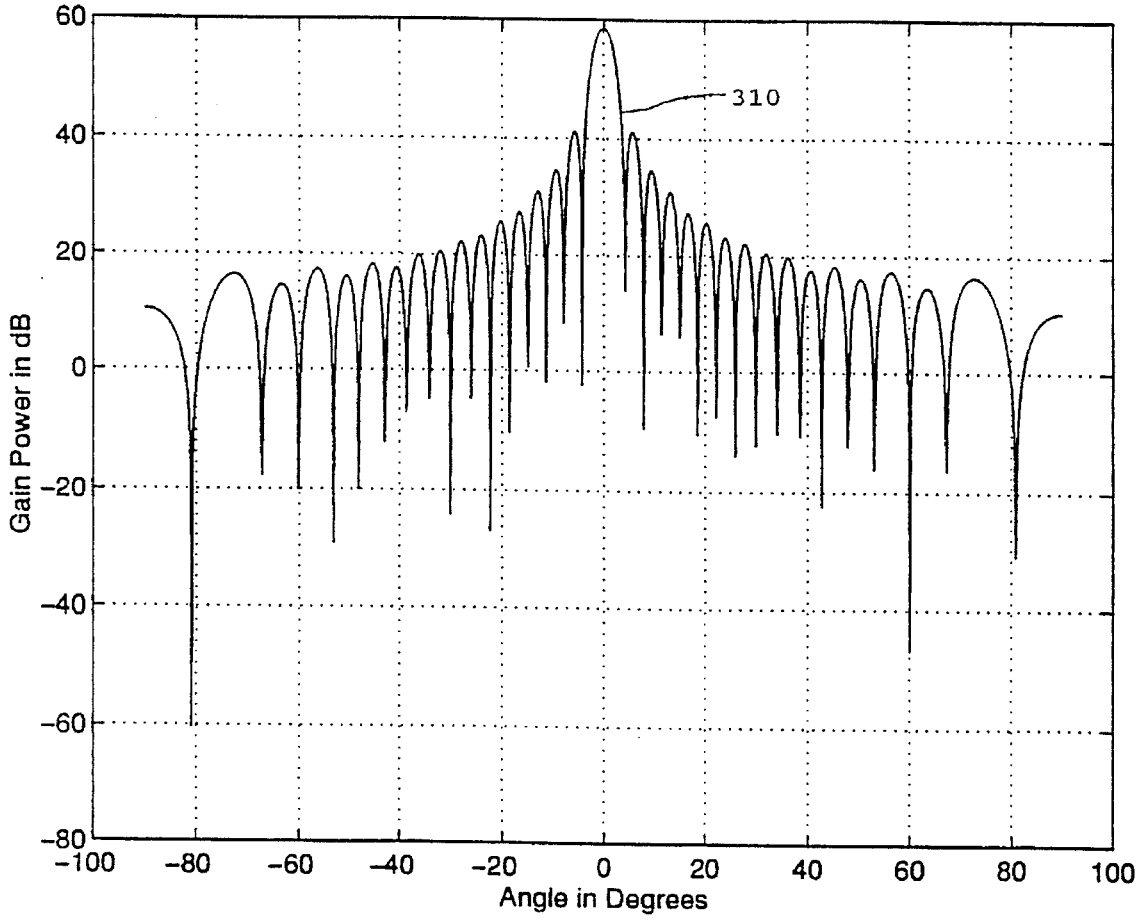
FIG. 3*a* is a calculated radiation or directivity pattern of the aperture of FIG. 2*c*.
Figure 3B:
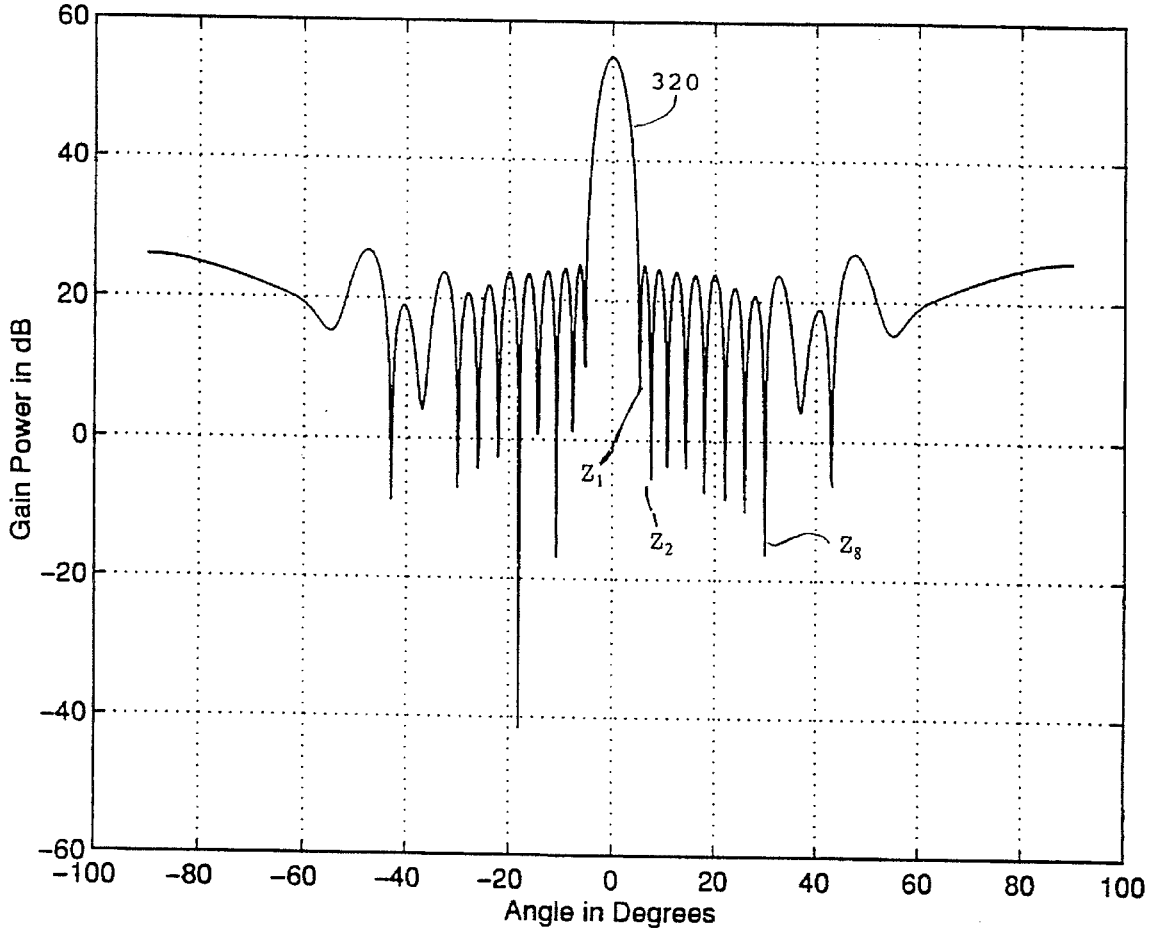
FIG. 3*b* is a corresponding radiation pattern of the thinned array of FIG. 2*b*.

FIG. 3*a* illustrates by a plot 310 the theoretical radiation or directivity pattern of the fully populated aperture of FIG. 2*a*, and FIG. 3*b* illustrates a radiation pattern 320 of the thinned array of FIG. 2*b*. Both the radiation patterns of FIGS. 3*a* and 3*b* assume that each antenna element radiates the same amount of power as any other antenna element. Those skilled in the art of array synthesis will recognize that the FIG. 2*a* and FIG. 2*b* shows the comparison between filled and thinned array respectively. In FIG. 2*b*, elements or T/R modules are selectively removed and spaced to enhance the performance of the array by an aspect of the present invention. The first sidelobe is 17 dB down from the main lobe or beam in FIG. 3*a*, while the first sidelobe is about 30 dB down from the main beam in FIG. 3*b*. FIG. 3*b* identifies the locations of the "zeroes" or nulls of the radiation pattern as $Z_i$, where $Z_1$, $Z_2$, and $Z_8$ are expressly designated.

According to an aspect of the invention, the thinning of the circular array is accomplished according to the equations:

$$J_0(\pi r_1 u_\Sigma(i)) = -\sum_{n=1}^{M-1} \{N_n^\Sigma Jo(\pi r_{n+1} u_\Sigma(i))\} \tag{1}$$

$$i = 1, \ldots, M-1,$$

$$u_\Sigma(i) = \frac{2a_M}{\lambda} \sin(\theta(i)), \tag{2}$$

The above linear equations are solved for the number of elements $N_n^\Sigma$ in each ring, normalized to the number of elements $N_1$ in the innermost ring, where $N_n/N_1=N_n^\Sigma$, located equally spaced on concentric rings of normalized radii $r_{n+1}$. These elements and their locations are illustrated in FIG. 2*b*. For example, FIG. 2*b* shows eight elements for the ring having the first or smallest radius, 14 elements for the second ring, . . . up to forty-six elements in the $16^{th}$ or outermost ring. It should be noted that $J_0$ represents a Bessel Function of the first kind and of order zero, which can be found in any standard mathematical tables. Further, the location of the sin ($\theta$(i)) of equation (2) corresponds to the zeroes $Z_i$ as illustrated in FIG. 3*b*.

Figure 4A:
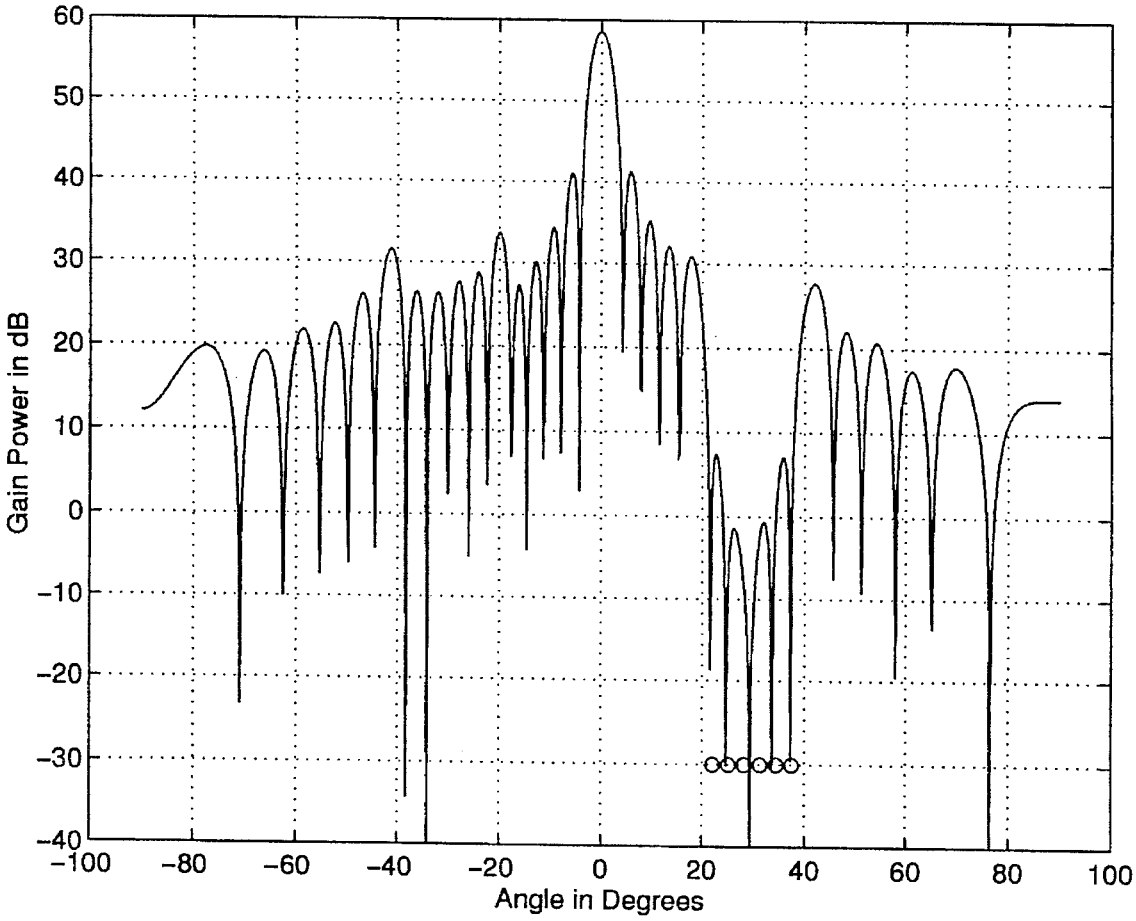
FIG. 4*a* is a "cut" of the radiation pattern of the filled array of FIG. 2*a* with a broad null created by phase perturbation.
Figure 4B:
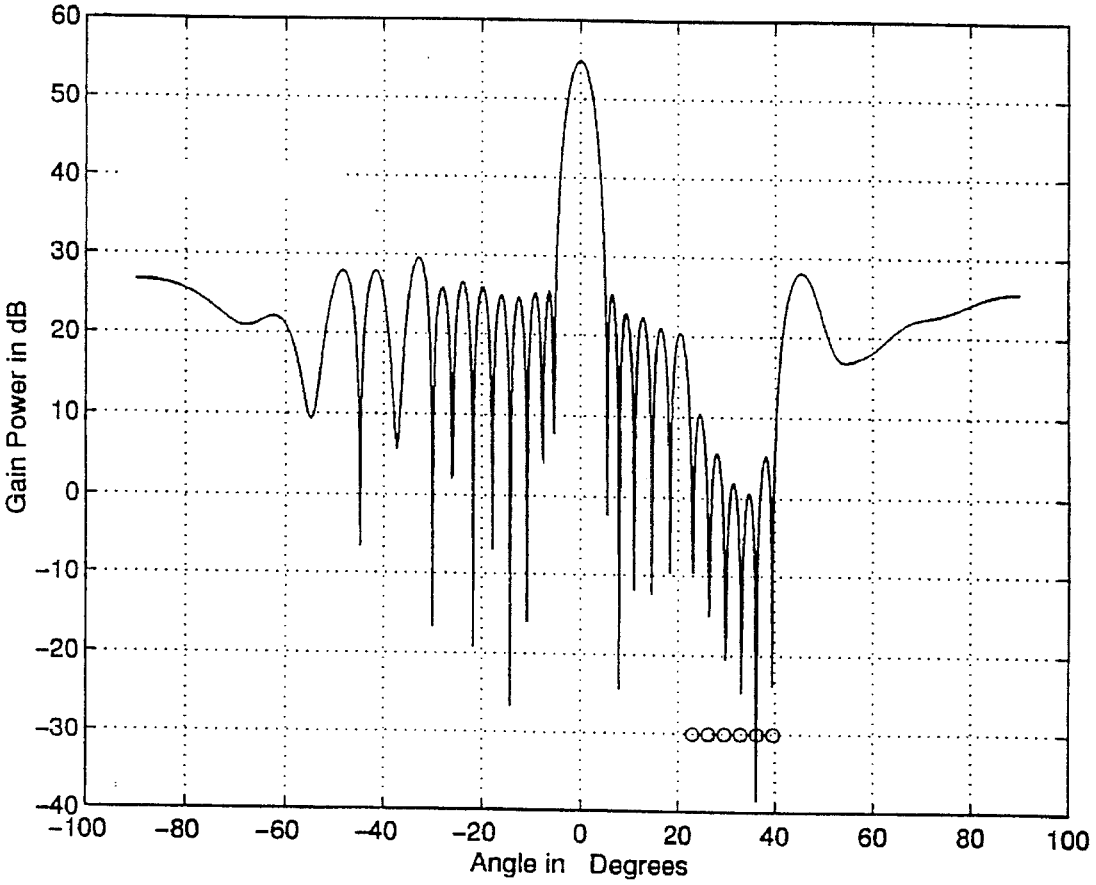
FIG. 4*b* is a corresponding pattern of the thinned array of FIG. 2*b*, with a wide null attributable to phase perturbation in accordance with the invention.

According to as aspect of the invention, a null is established in the directivity pattern of the array in a clutter or jammer direction $\theta$, $\phi$ by first (a) selecting a set of control points in its vicinity, as shown in FIG. 4*b*. The number, locations and relative positions of the control points establish the location, width and depth of the null. The null is then established by (b) computing the phase perturbations to be applied to each element using matrix equation (3):

$$\overline{\Phi} = \overline{E}' (\overline{E}\,\overline{E}')^{-1} \overline{B} \tag{3}$$

In equation (3), $\overline{\Phi}$ represents a column matrix, the size of which equals the number of elements in the antenna array, $\overline{E}$ and $\overline{B}$ are matrices whose size depend upon the number of control points and number of elements, and are computed using equations (30) and (31) in the perturbation signal generator portion of phase controller 20. These phase perturbations are then applied to the array elements by use of phase controller 20 for forming the desired null to suppress clutter.

Thinning reduces the cost, as known in the art, and as described in the abovementioned Perry et al. patent. The particular thinning described by equation (1) and (2) is selected so that a wide null can be made in the directivity pattern by the phase shifts described in equation (3). In general, a thinned array has not in the past been considered to be a candidate for nulling, because of the computational difficulties, or because the resulting nulls could not be made relatively broad. The above-described combination of thinning and nulling has obvious cost advantages for commercial radars, especially for air traffic control, and for corresponding purposes.

ANALYSIS

Thinning the Circular Aperture

Consider space factor E, in spherical coordinates θ and ϕ, for N elements on a planar surface, each element having a current distribution of $I_n$:

$$E(\theta,\phi)=\sum_{n=1}^{N} I_n e^{a_n jk\cos(\phi-\phi_n)\sin\theta-j\alpha_n\kappa a_n} \tag{4}$$

where $$\alpha_n=\sin(\theta_0)\cos(\phi_0-\phi_n) \tag{5}$$

Where θ and ϕ are the spherical angles, $\theta_0$ and $\phi_0$ are the steering angles, κ is the wave number, and $a_n$ is the radial distance from the center of the aperture of radius $a_N$. In equation (4), we set the steering angle be $\alpha_n=0$, but the analysis for an arbitrary steering is equally valid.

For computational purposes we need to work with a set of rings, each having a number of equally spaced elements. The number of elements on each ring is the unknown variables which must be determined for each ring.

Then with M set of rings spaced ½λ apart, the aperture is ½M units. Equation (4) can be written as $$E(\theta,\phi)=\sum_{m=1}^{M}\sum_{n=1}^{2N_m} I_{n,m} e^{j\kappa a_{m,n}\cos(\phi-\phi_{nm})\sin\theta} \tag{6}$$

where $2(N_1+\ldots+N_M=N)$. $I_{n,m}$ is the illumination of the element on the $m^{th}$ ring that has $2N_m$ elements located equally spaced on the ring. (The factor 2 is for the symmetry needed to form monopulse difference beams.)

To illustrate the basic idea of the thinning procedure, we will reduce the inner sum of equation (6) is reduced to an integral formula. We let the current $I_{nm}=I_m$, i.e., same current for all elements located on $m^{th}$ ring. Let $$\phi_{mn}=\frac{2\pi(n-1)}{2N_m}=2\pi\alpha \tag{7}$$

$$E(\theta,\phi)=\sum_{m=1}^{M}\sum_{n=1}^{2N_m} I_m e^{j\kappa a_m\cos(\phi-\frac{\pi(n-1)}{N_m})\sin\theta} \tag{8}$$

After some manipulation it can be seen that the inner sum in equation (8) is an approximation to an integration formula and hence can be replaced by $$E(\theta,\phi)\approx\sum_{m=1}^{M} N_m 2 I_m \frac{1}{2}\pi\int_0^{2\pi} e^{j\kappa a_m\cos(\alpha)\sin\theta}d\alpha \tag{9}$$

Using the integral representation of the Bessel function of the first kind we have $$E(\theta,\phi)\approx 2\sum_{m-1}^{M} N_m I_m J_0(\kappa a_m\sin\theta) \tag{10}$$

The above expression is independent of ϕ, as expected, from the dominant term approximation.

Now consider a representative continuous circular aperture. The space factor is then given by $$E^R(\theta,\phi)=\frac{1}{2\pi}\int_{\phi}^{\phi+2\pi}\int_0^{\pi} pg(p,\phi)\, e^{jpu\cos(\phi-\phi)}\,dp\,d\phi \tag{11}$$

Where g (p, ϕ) is the current density and $$u=\frac{2a_M}{\lambda}\sin\theta. \tag{12}$$

Now we do the discretization of the above in such a fashion that g (p,ϕ)pdp, which is proportional to current in the ring of thickness dp, is represented by $N_m$ Using the integral representation of the Bessel function, we have $$E^R(\theta,\xi)=\sum_{m=1}^{M} 2N_m J_0(\kappa a_m\sin\theta) \tag{13}$$

Direct comparison of the representative aperture and the aperture to be thinned is quite straightforward from equations (10) and (13). The illumination function of the representative aperture corresponds to the number of elements lying on the $m^{th}$ ring, each element having an illumination of unity, which is precisely the problem at hand.

From the above analysis we will now use our reference circular array given by equation (11) to obtain our thinned array.

Zero Sampling Method

Consider the synthesis of the reference array as Taylor synthesis, as described, for example in "*Design of Circular Aperture for Narrow Beam Width and Low Sidelobes*", by T. T. Taylor, published at pp 23–26 in *IRE Transactions on Antennas and Propagation*, January, 1960. Any other comparable synthesis can be used. The Taylor method is well known and for simplicity we shall use the zeroes of Taylor analysis. More refined iteration can be used if more accuracy is desired.

An important basis for the invention is that the aperture to be thinned and the circular aperture as analyzed by Taylor have the same mathematical representation, provided that Taylor's current distribution is equated to the number of elements in each ring of the aperture to be thinned. Using this analogy, we first find the current distribution based upon the Taylor theory which gives a controlled set of sidelobes, and then determine the normalized number of elements on each ring. This deterministic method is distinctly different from the random thinning ordinarily used for antenna arrays.

After the deterministic thinning, the sidelobes are well controlled, and below the levels for a fully populated array. Nulling becomes possible by a small shift in the element phases, as by a perturbation phase generator, known in the art, associated with the phase controller 20 of FIG. 1*a* and 1*b*.

The method can be explained as follows: first select or fix M, the number of the rings to be used. Since the rings are spaced half a wavelength apart, M is twice the aperture radius in units of wavelength. Then for the representative aperture select $\bar{n}$, the number of sidelobes to be controlled, and the sidelobe power ratio R. R is the ratio of the mainlobe amplitude to the first sidelobe; making R very large causes deterioration (increase in amplitude) of the other sidelobes away from the main beam, because of conservation-of-energy considerations. Thus, pushing down a selected one or ones of the sidelobes results in either widening of the main lobe, which may be undesirable because of resolution, or raising the remaining sidelobes. A is computed from $$A = \frac{\cosh^{-1}(R)}{\pi} \tag{14}$$

As given by Taylor's method for the representative aperture, we define the stretching parameter σ for the near-in zeroes of the pattern for the representative aperture as $$\sigma = \frac{\mu(\bar{n})}{\sqrt{(\bar{n}-0.5)^2 + A^2}} \tag{15}$$

The zeroes μ of the radiation pattern are simply given by $$u(i) = \sigma\sqrt{\left(i - \frac{1}{2}\right)^2 + A^2} \quad , i = 1, \ldots, \bar{n} - 1 \tag{16}$$

and $$u(i) = \mu(i),\ i = \bar{n}, \ldots, M \tag{17}$$

where μ(i) are the zeroes of the first derivative of the Bessel function of order zero and $$u = \frac{2a_M \sin\theta}{\lambda} \tag{18}$$

If the sidelobe ratio R is selected to be very large, then the far sidelobes will deteriorate, i.e. they will become larger relative to the mainlobe. Since far sidelobes are controlled by the total number of elements, an acceptable compromise value of R can be easily selected to keep the RMS value of sidelobes nearly uniform.

Now we sample the main array at the zeroes given above ($E(u_i)=0$), and normalizing with respect to number of elements $N_1$ for the first ring, we obtain the above-mentioned equation (1) to be solved for $N_n^{\Sigma}$, where $N_n^{\Sigma}=N_n/N_1$.

$$J_0(\pi r_1 u_\Sigma(i)) = -\sum_{n=1}^{M-1} \{N_n^{\Sigma} Jo(\pi r_{n+1} u_\Sigma(i))\}$$

$$i = 1, \ldots, M-1,$$

where i=1, . . . M−1;

$u_\Sigma(i)$ is given by equation (2); and $r_n = a_n/a_M$.

It should be noted that the maximum number of antenna elements we can have at the first ring is $N_1=4\pi a$. Hence, the element set for the thinned array is then given by $$N_m = N_1 N_m^{\Sigma},\ m>1 \tag{19}$$

Analysis for Nulling

FIG. 4*a* represents a two-dimensional "cut" through the radiation pattern of a fully populated aperture as in FIG. 2*a*, with a wide null in the region of 22° to +40° attributable to phase perturbation, and FIG. 4*b* represents the corresponding radiation pattern of the thinned array of FIG. 2*b*, with a null in the +20° to +40° range attributable to phase perturbation in accordance with the invention. Comparison of the peak sidelobe levels of FIGS. 4*a* and 4*b* reveals that the thinned array has a peak sidelobe level which is about −30 dB, while the fully populated array has a peak sidelobe level of only −17 dB, which is a 13 dB improvement in the case of the thinned array. Also, the null in the sidelobes, attributable to phase perturbation in accordance with the invention, is about 12 dB below the near-in sidelobes in the case of the thinned array, and about 22 dB in the case of the unperturbed array. The locations of the wide nulls are selected in a direction in φ and θ for removal of ground, jammer or other clutter. The perturbation phases represented by vector Φ having the dimension equal to the number of antenna elements or T/R modules is explicitly given by equation (3)

$$\bar{\Phi} = \bar{E}'(\bar{E}\bar{E}')^{-1}\bar{B}$$

The space factor for uniformly illuminated elements can be represented by:

$$g(T_x, T_y) = \sum_{k=1}^{N} e^{j\phi_k} e^{j\kappa(t_x X_k + T_y Y_k)} \tag{20}$$

where

N=total number of elements $\kappa=2\pi/\lambda$ $\phi_k$ are the phases $T_x=\sin(\theta)\cos(\phi)$ $T_y=\sin(\theta)\sin(\phi)$ For the phase perturbation, we let $$e^{j\phi_k} \approx 1 + j\phi_k \tag{21}$$

neglecting the higher order terms. Hence, equation (20) can be written as $$g(T_x, T_y) = g_0(T_x, T_y) + j\sum_{k-1}^{N} \phi_k e^{j\kappa(T_z X_k + T_y Y_k)} \tag{22}$$

where $$g_0(T_x, T_y) = \sum_{k=1}^{N} e^{j\kappa(T_x X_k + T_y Y_k)} \tag{23}$$

Let the nulls to be formed be at $T_x^i$, $T_y^i$, where i=1, . . . , M. Then we have $$0 = g_0(T_x^i, T_y^i) + j\sum_{k=1}^{N} \phi_k e^{j\kappa(T_x^i X_k + T_y^i Y_k)} \tag{24}$$

In general, the number of control points M is much smaller than N. Equation (24) gives M equations for N unknowns, a highly under-determined system. At this point, it is convenient to write equation (24) in matrix form. Hence, define:

$$C_k^i = e^{j\kappa(T_x i X_k + T_y i Y_k)} \tag{25}$$

where k=1,2, . . . , N and i=1,2, . . . , M. Let $$RC_k^i = \Re(C_k^i)\ IC_k^i = \Im(C_k^i) \tag{26}$$

Hence (23) can be written as $$g_0(T_x^i, T_y^i) = \sum_{k=1}^{N} RC_k^i + jIC_k^i, \tag{27}$$

$$i = 1, \ldots, M$$

And (24) gives $$\sum_{k-1}^{N} \phi_k IC_k^i = \sum_{k=1}^{N} RC_k^i \equiv RC_0^i \tag{28}$$

and

-continued $$\sum_{k=1}^{N} \phi_k RC_k^i = -\sum_{k=1}^{N} IC_K^i \equiv -IC_o^i \tag{29}$$

In matrix form, equations (28) and (29) become $$\overline{IC}\,\overline{\Phi}=\overline{RC_0} \tag{30}$$

$$\overline{RC}\,\overline{\Phi}=-\overline{IC_0} \tag{31}$$

where:

$\overline{IC}$,$\overline{RC}$ are matrices, each of dimension (M×N), with each term given by equation (26);

$\Phi$ is an (N×1) matrix; and $\overline{IC_0}$,$\overline{RC_0}$ are matrices of dimension (M×1) where each term is the sum over all the elements for a given clutter or jammer location of equation (26). Combining equations (30) and (31), we have the real set of equations, including the E and B matrices, given by $$\overline{E}\,\overline{\Phi}=\overline{B} \tag{32}$$

The E matrix in equation (34) is constructed from the IC and RC submatrices, and the B matrix is constructed from the $RC_0$ and $-IC_0$ matrices, and $\overline{E}$ is the column matrix (or a vector). For example, for six control points, and N=556 elements in a thinned array, E is 12-by-556, B is 12-by-1, and where $\overline{E}$ is 556-by-one, i.e. there are 556 unknowns. Usually, solutions require the same number of equations as there are unknowns. In the present case, this is not possible, so a solution is sought which minimizes a cost function. The selected cost function which allows this result is the sum of the squares of the unknown phases with the side constraints to obtain the nulls.

To obtain the minimum-norm solution, we construct a functional corresponding to the norm of the phase vector together with side constraints using Lagrange multipliers.

$$J=\frac{1}{2}\,\langle\overline{\Phi}^*\,\overline{\Phi}\rangle-\overline{\lambda}'(\overline{E}\overline{\Phi}-\overline{B}) \tag{33}$$

symbolic minimization of the above gives $$\frac{\delta J}{\delta\phi}=\overline{\Phi}-\overline{E}'\overline{\lambda}=0 \tag{34}$$

Hence, $$\overline{\Phi}=\overline{E}'\,\overline{\lambda} \tag{35}$$

Using (32) in equation (35), we get $$\overline{\lambda}=(\overline{E}\,\overline{E}')^{-1}\,(\overline{B}) \tag{36}$$

Substituting $\overline{\lambda}$ of equation (36) into equation (22) gives equation (3)

$$\overline{\Phi}=\overline{E}'\,(\overline{E}\,\overline{E}')^{-1}\overline{B}$$

which is the min-norm solution. It should be noted that inverse in equation (3) is only for a (2M×2M) matrix.

Control Point Spacing

The number of control points and spacing of such control points strongly affects the depth and the angular extent of the null. It was discovered that the spacing can be determined by an analysis similar to the asymptotic analysis described in the abovementioned T. T. Taylor article. As the number of elements of a Dolph-Tchebychoff array is indefinitely increased, the zeroes of the asymptotic space factor can be represented by where:

$$Z_n=\pm\sqrt{A^2+\left(n-\frac{1}{2}\right)^2} \tag{37}$$

R is the ratio of the sidelobes to the main lobe; and $$A=\cosh^{-1}\left(\frac{R}{\pi}\right) \tag{38}$$

As n increases, these zeroes must match the asymptotic zeroes of the realistic space factor, as explained by T. T. Taylor, above. Based on the above observation and relating the sidelobe ratio to the null depths ratio, the control spacing can be selected as follows. Define null depth desired in dB, and obtain $$R=e^{\left(\frac{\log_{10}dB}{20}\right)} \tag{39}$$

and $$A=\cosh^{-1}\left(\frac{R}{\pi}\right) \tag{40}$$

$$\sigma=\frac{M}{\sqrt{A^2+\left(M-\frac{1}{2}\right)^2}} \tag{41}$$

where M is a set of control points $$u_i=\sigma\sqrt{A^2+\left(i-\frac{1}{2}\right)^2}\qquad i=1,\ldots,M. \tag{42}$$

$$\Delta u=\frac{\Sigma\Delta u_i}{M-1} \tag{44}$$

And hence, $$\Delta\theta=\sin^{-1}\left(\frac{\lambda\Delta u}{2a}\right) \tag{45}$$

where a=aperture.

This analysis gives the angular spacing between the nulls and M can be selected depending on the extent of the null desired. It was found that wider notches result in shallower nulls.

Other embodiments of the invention will be apparent to those skilled in the art. For example, the analysis may be performed by other methods equivalent to the described method, which result in the same structure.

What is claimed:

1. An active array antenna, comprising:

a first plurality N of elemental antennas;

a plurality of T/R modules, each including at least an input port, an output port, and a phase control port, each of said T/R modules having its output port coupled to an associated one of said elemental antennas, for, in a transmitting mode of operation, receiving signals at said input port, and for producing amplified signals at said output port at a phase controlled by a phase control signal applied to said phase control port, the signals produced at said output ports of said T/R modules being of equal amplitude;

antenna element support means, for physically supporting said plurality of elemental antennas in a circular aperture, each of said elemental antennas being located in said aperture on one of a plurality M of concentric rings of said elemental antennas, each of said elemental antennas on each of said rings being equidistant from adjacent ones of said elemental antennas on the corresponding ring, the number $N_n^{\Sigma}$ of said elemental antennas in each of said M rings being accordance with a solution of $$J_0(\pi r_1 u_\Sigma(i)) = -\sum_{n=1}^{M-1} \{N_n^{\Sigma} Jo(\pi r_{n+1} u_\Sigma(i))\}$$

where i=1, . . . , M−1;

$r_{n+1}$ is the radius of each ring other than the innermost ring, normalized to the radius of the aperture;

$J_0$ is a Bessel function of the first kind and the zero order; and $$u_\Sigma(i) = \frac{2a_M}{\lambda} \sin(\theta(i)),$$

where $a_M$ is the radial distance of the outermost ring from the center of said circular aperture;

phase control means coupled to said control ports of said T/R modules, for controlling the phase of each of said T/R modules in such a manner as to generate a phase distribution across said aperture which results in a directivity pattern including a main beam having an angular extent, and a plurality of sidelobes outside said angular extent of said main beam, said sidelobes having a predetermined sidelobe level; and phase perturbation means coupled to said phase control means, for perturbing said phase of said T/R modules in accordance with $$\overline{\Phi} = \overline{E}'(\overline{E}\,\overline{E}')^{-1}\,\overline{B}$$

where:

$\overline{\phi}$ is a matrix of the individual phase perturbations of the T/R modules;

$\overline{E}$ and $\overline{B}$ are matrices derived from a solution of $$\overline{IC}\,\overline{\Phi} = \overline{RC_0}$$

$$\overline{RC}\,\overline{\Phi} = -\overline{IC_0}$$

and $\overline{E}'$ is a matrix transpose of matrix $\overline{E}$, for thereby generating a null in said directivity pattern at a location θ, ϕ outside said angular extent.

* * * * *